United States Patent [19]

Bellinger

[11] 4,389,127

[45] Jun. 21, 1983

[54] HIGH SPEED DOT MATRIX IMPACT PRINTER

[75] Inventor: James E. Bellinger, Melbourne, Fla.

[73] Assignee: Florida Data Corporation, Melbourne, Fla.

[21] Appl. No.: 273,123

[22] Filed: Jun. 12, 1981

Related U.S. Application Data

[63] Continuation of Ser. No. 101,811, Dec. 10, 1979, abandoned.

[51] Int. Cl.[3] ..... B41J 3/12

[52] U.S. Cl. ..... 400/124; 101/93.05

[58] Field of Search ..... 101/93.29, 93.34, 93.48, 101/93.05; 400/124, 157.1, 157.2, 157.3

[56] References Cited

U.S. PATENT DOCUMENTS

| | | | |
|---|---|---|---|
| 3,467,232 | 9/1969 | Paige | 400/124 |
| 3,670,647 | 6/1972 | Funk et al. | 400/157.2 X |
| 3,707,122 | 12/1972 | Cargill | 101/93.34 |
| 3,745,495 | 7/1973 | Chai et al. | 101/93.29 X |
| 3,748,613 | 7/1973 | Venker | 101/93.29 X |
| 3,900,094 | 8/1975 | Larsen et al. | 101/93.05 X |
| 3,941,052 | 3/1976 | Dalziel | 101/93.48 |
| 4,136,978 | 1/1979 | Bellinger et al. | 400/124 |
| 4,156,960 | 6/1979 | Ikeda | 400/124 X |

*Primary Examiner*—Paul T. Sewell

*Attorney, Agent, or Firm*—Howard L. Rose

[57] ABSTRACT

A compact, light weight, high speed, dot matrix printing head comprises a generally circular array of stylus drivers. The printing head employs a generally circular permanent magnet common to all drivers and mounted centrally of the device. Each driver includes an arm having a stylus secured at one end thereof generally perpendicular to the arm and an armature of an electromagnet mounted on the other end of the arm. A magnetic circuit of each driver includes a section of the permanent magnet and bucking coil electromagnet in a short generally rectangular structure with the armature located at one corner of the structure such corner formed by a pole of electromagnet and a pole of the permanent magnet. The arm is carried on crossed flexures providing a pivot point for the arm in the plane of the interface of the armature and pole of the electromagnet to reduce wear. The arrangement of the structure causes the air gap forces to produce moments which are additive. The rectangular arrangement permits the coil of the electromagnet to be the outermost component of each driver so that sufficient cooling of the coil may readily be provided to permit the high current operation required at the desired operating speeds (800 characters per second) without damage to the coils. The high current capacity of the coil and the compact magnetic structure permits reliable operation.

27 Claims, 8 Drawing Figures

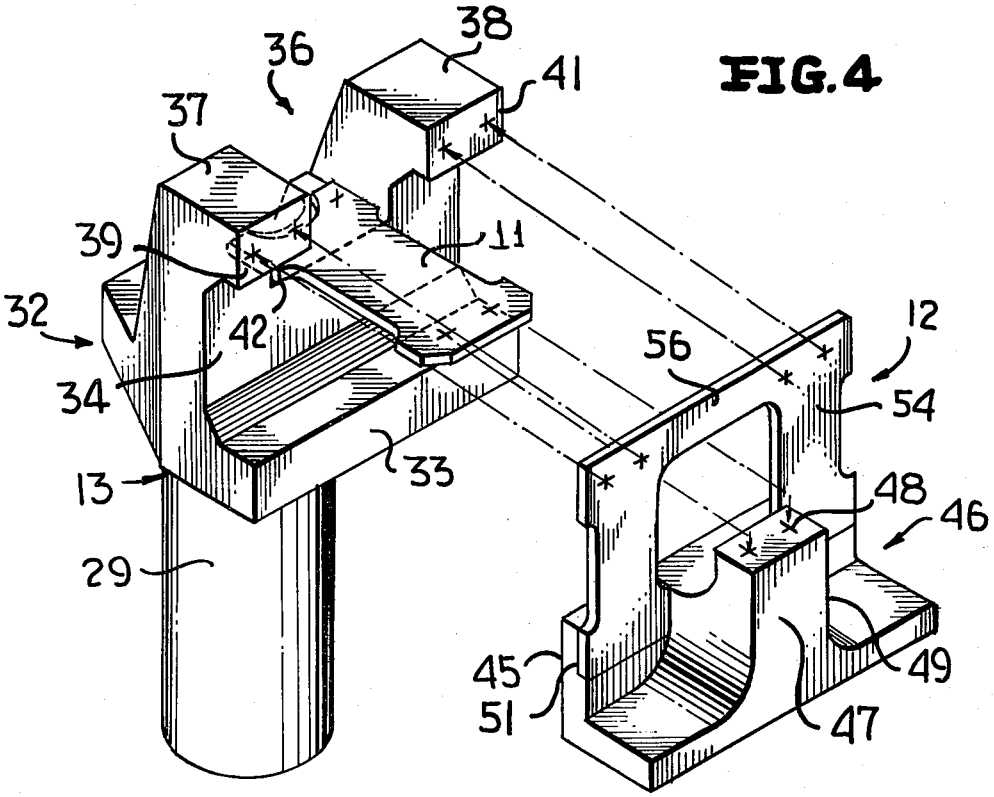
FIG.4
FIG.5
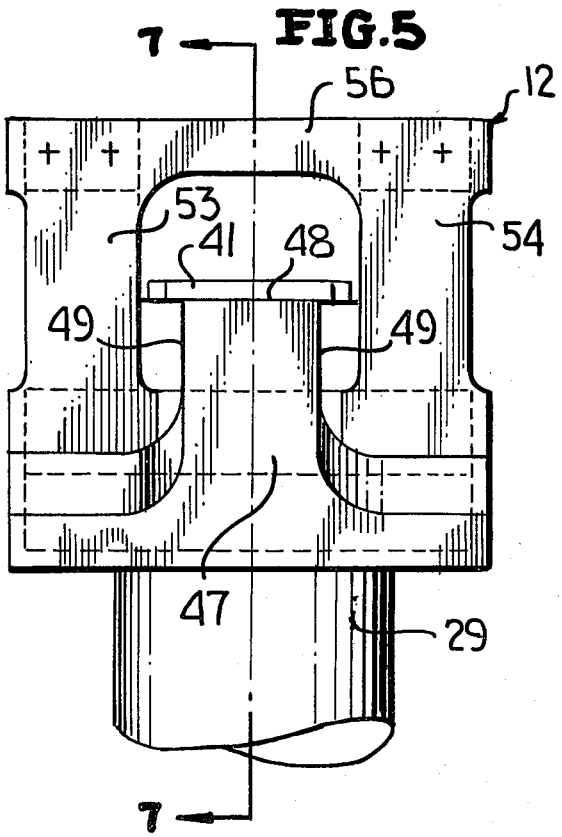
FIG.6
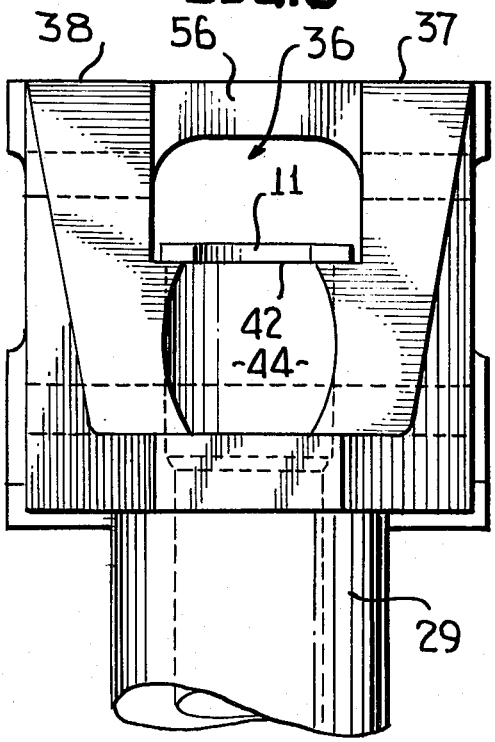

HIGH SPEED DOT MATRIX IMPACT PRINTER

This is a continuation of application Ser. No. 101,811, filed Dec. 10, 1979, abandoned.

RELATED APPLICATION

This application is related to my copending application Ser. No. 101,812, filed on concurrent date herewith.

TECHNICAL FIELD

The present invention relates to dot matrix printers and more particularly to a long-lived, light weight, high speed printer head for use in dot matrix printers.

BACKGROUND ART

The pertinent prior art known to the inventor is U.S. Pat. No. 4,136,978 issued Jan. 30, 1979. The printer head of said patent includes 7 to 9 modules each controlling a stylus for printing 7 to 9 level dot matrix characters. Each module includes a printer arm carrying a stylus at one end, the arm being supported by a prestressed crossed flexure arrangement at the other end. A soft iron insert which forms the armature of an electromagnet is carried by the arm adjacent its supported end. The electromagnet and a permanent magnet together with the armature are included in a magnetic circuit with the electromagnet bucking the permanent magnet when energized.

The electromagnet is normally de-energized and the insert is attracted to the pole of the electromagnet by action of the permanent magnet. Energization of the electromagnet reduces the flux in the magnetic path, the armature is released and the prestressed crossed flexures move the arm so that the stylus impacts the surface on which printing is to occur. The stylus arm rebounds from said surface and is captured by the pole of the electromagnet; the latter having been de-energized by the time the rebounding arm approaches its nonprinting position.

The aforesaid modules have been well received in the market place, providing printing speeds equal to low speed line printers (600 characters per second) at a cost well below the cost of such line printers. Some problems, however, have become apparent as a result of extended use of the device. Lack of rigidity between the pole face and crossed flexure mount result in fidgeting of contacting armature and pole surfaces with resultant wear. In order to achieve the desired life of the head, upwards of 500 million characters, it has been necessary to oil the abutting surfaces.

Oiling of the abutting surfaces introduced two problems the first of which is that the operators of the printer do not want to oil the heads even though such procedure requires applying only 8 drops of oil about once every week or two. The second problem is that the oil causes the printer to occasionally drop a dot or two in the first character upon start up after the machine has been shut down; usually overnight.

In addition to the above problems the prior head is somewhat difficult to assemble and is more costly than desired.

The head of the patent is saleable and is currently being sold. The problems described, although being somewhat bothersome, do not prevent sale of the apparatus because its speed of 600 characters per second at a reasonable cost provides a ready market for the device.

DISCLOSURE OF THE INVENTION

In accordance with the present invention, the basic magnetic circuit approach of the aforesaid patent is retained but is modified to increase the available magnetic force and permit increased cooling of the electromagnets. Further, the arm supports are modified to provide greater rigidity to increase the life of the apparatus (reduce wear without the use of oil), and reduce the cost and time of manufacture.

Specifically the magnetic circuit includes, as in the patented device, an armature, a permanent magnet and an electromagnet used as a bucking coil to neutralize the flux of the permanent magnet. The magnetic circuit, however, is restructured so that the circuit and the arm lie in the same plane with the coil of the electromagnet disposed as the outermost element of each module of the multimodule printer head. Such arrangement provides a short magnetic circuit and permits location of the electromagnets (actually the coils of the magnets) as the outermost elements whereby the coils may be readily cooled. Such arrangement allows the coils to draw high currents without damage for purposes to be explained subsequently.

In the device of the present invention a single annular disc-shaped permanent magnet is common to all modules thus simplifying the structure and the assembly of the head. Specifically, a base with an upstanding circular hub is provided and the permanent magnet is mounted on and coaxial with the hub. The individual modules are upstanding from a flange extending generally radially outwardly from the base of the hub. The permanent magnet is easily placed on and secured to the hub and the electromagnetic coils are mounted on rods secured to the edge of the flange. The poles of the electromagnets which also provide the support for the arm flexures are secured to the same rods providing a member generally parallel to the base; the rod being generally parallel to the axis of the hub. As will become evident subsequently, the flexures may be quickly and accurately secured to the pole of the electromagnet providing a rigid support structure.

Of beneficial effect to the performance of the apparatus of the present invention is that the annular magnet may be relatively thin as a result of the total volume (and resultant flux generating capacity) available from the annular arrangement. The thin magnet permits the magnet circuit to be shortened relative to the prior design and thus quite efficient.

As previously indicated, the arrangement of the magnetic structure in line with the arm also reduces the length of the magnetic path so that the use of the specific structure in conjunction with the annular magnet provides a path which is materially shorter than that of the prior device and the overall efficiency of the present device is greatly increased.

The location of the coil of each electromagnet as the outermost element of each module permits the coils to be readily cooled and thus the coils have a large current carrying capacity.

The magnetic structure recited above provides essentially a rectangle with the flange and pole of the electromagnet forming two of the parallel sides and the rod (coil) and permanent magnet and its hub and pole forming the other two parallel sides. The permanent magnet leg and the pole of the electromagnet are shorter than their respective parallel legs leaving an air gap at a corner of the magnetic circuit in which is located the armature secured to the arm. Mounting the armature in the corner of our magnetic circuit is what permits such an extremely small armature considering the forces involved, and consequently, the high speed of operation. The armature abuts the pole of the electromagnet when in the non-print condition and is permanently spaced from the permanent magnet pole by a quite small air gap.

The location of the armature in the corner of the magnetic circuit essentially disposes the magnetic structure on one side of the arm. The arm moves away from the structure to accomplish printing and thus may be placed quite close to the printing surface. As a result, in one embodiment of the invention, styli are used that are sufficiently short that a guide block is not required, eliminating another source of wear in the apparatus.

An additional important feature of the invention resulting from the method of supporting the armature is greatly decreased wear on the abutting surfaces of the armature and pole of the electromagnet. Cross flexures supporting the arm are positioned such that the effective pivot of the arm is located in the plane of the interface between the armature and electromagnetic pole. As a result, no material rubbing of the faces is encountered on contact and the life of the apparatus is greatly increased. Further, since the flexure is mounted directly on the pole structure, and very close to the pole face, the resultant structure is extremely rigid. Specifically, any motion of the pole due to vibration carries the close coupled armature with it so that there can be practically no relative motion between pole and armature, virtually eliminating wear, and need for lubrication.

The resulting structure is capable of sustained operations at 800 characters per second and it has been found that no significant wear has been encountered after 400 hours of operation ($800\times10^6$ characters) without oiling.

It is an object of the present invention to provide a long-lived, high speed, dot matrix, impact printer.

Still another object of the present invention is to provide a high speed, dot matrix, printer which, relative to the known prior art, is less expensive, lighter in weight and employs only one-third the number of parts.

It is an object of the present invention to provide a cross flexure support as part of the pole structure of a dot matrix printer.

Yet another object of the present invention is to provide a cross-flexure support for a printing arm wherein the pivoted axis of the arm lies in the plane of the interface between an arm mounted armature and the pole of the electromagnet controlling movement of the arm.

Still another object of the present invention is to provide a magnetic circuit structure basically resembling a rectangle with one corner removed and a movable armature disposed at the location of the missing corner whereby torques produced by forces established by the flux in the gaps between the armature and the circuit are additive.

Yet another object of the present invention is to provide a matrix printer structure providing close mechanical coupling between the armature and pole of an electromagnet of a combined electro and permanent magnet printer control structure.

Another object of the present invention is to provide a module for controlling movement of a stylus bearing arm between non-print and print positions, wherein control of the arm is by means of a magnetic circuit located substantially wholly adjacent to the side of the arm remote from the surface on which printing is to occur.

Still another object of the present invention is to provide a single permanent magnet for use by multiple print modules of a dot matrix impact printer wherein control of printing is accomplished by selective energization of a different electromagnet in each module to buck the flux established in its associated circuit by a permanent magnet common to all magnetic circuits.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein:

FIG. 4 is an exploded view of the fiexure and arm supports and the armature of the invention.

FIG. 5 is an end view of the armature and the arm and flexure supports from the center of a module.

FIG. 6 is an end view of the armature and flexure support taken from external of a module.

BEST MODE FOR CARRYING OUT THE INVENTION

The terms "vertical," "horizontal," "top plate," "bottom plate" and similar expressions denoting locations are used herein only for the purpose of facilitating description and are not intended to be limiting. In fact, the position of the print head on its carriage is such that vertical members become generally horizontal members and top and bottom plates become side plates.

Figure 1:
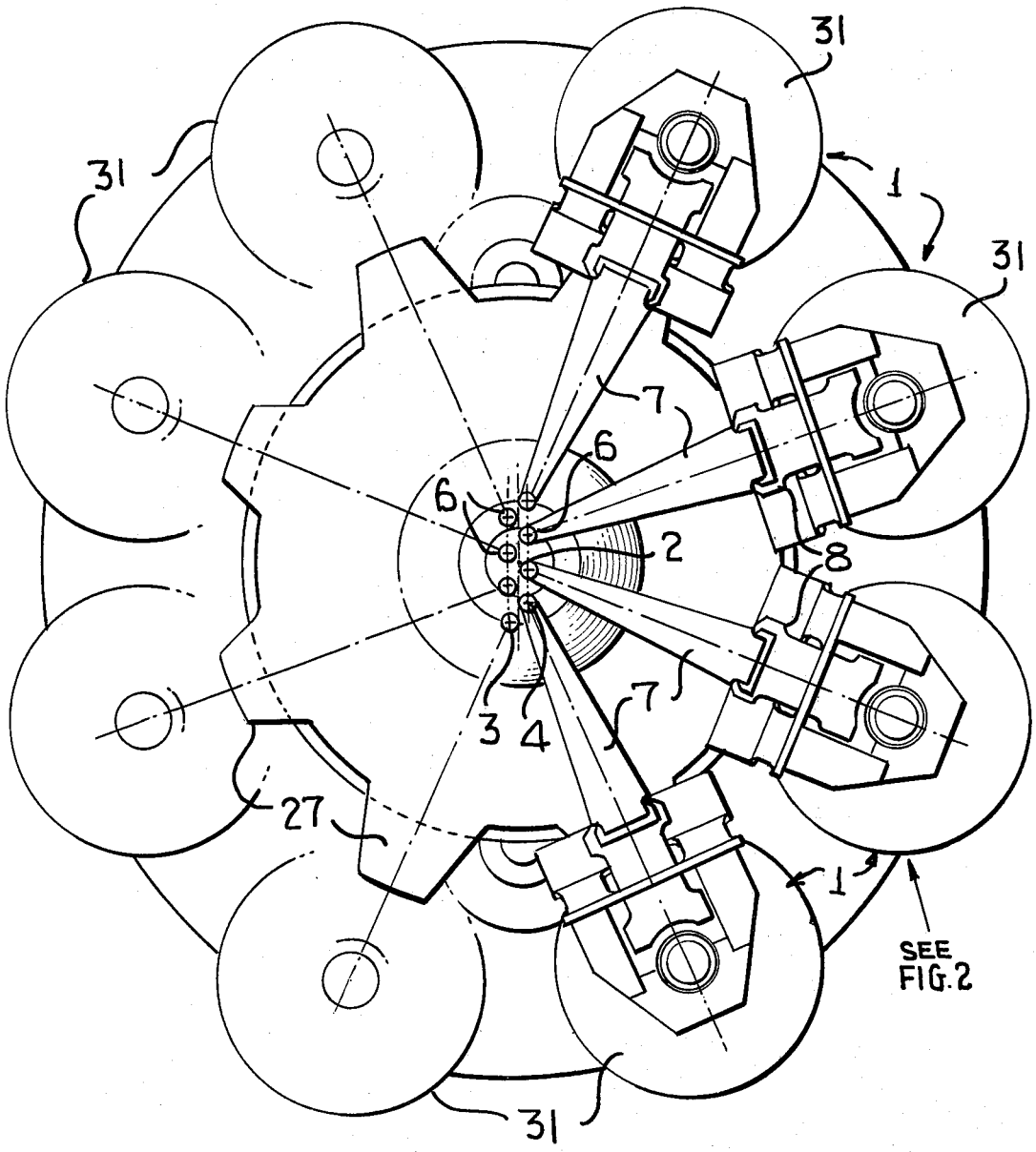
FIG. 1 is a view of the print head from the stylus side of the device and illustrating a first embodiment of the module and stylus arrangement.

Referring now specifically to FIG. 1 of the accompanying drawings, there is illustrated a top plan view (with the stylus, ribbon guide and top plate removed) of a print head constructed in accordance with the principles of the present invention. The illustrated version of the head is indicated as providing eight stylus drivers 1 capable of printing a $7\times5$, $7\times7$, $7\times8$ or higher resolution fonts with the eighth stylus providing for descenders. Fonts of $7\times7$ and $9\times7$ for printing upper and lower case characters may also be employed. With the $8\times7$ or $9\times7$ fonts, all vertical positions can be and are printed whenever required.

The head illustrated in FIG. 1 is carried by a printing mechanism carriage (not illustrated) to produce a line of characters of up to as many as desired.

Figure 2:
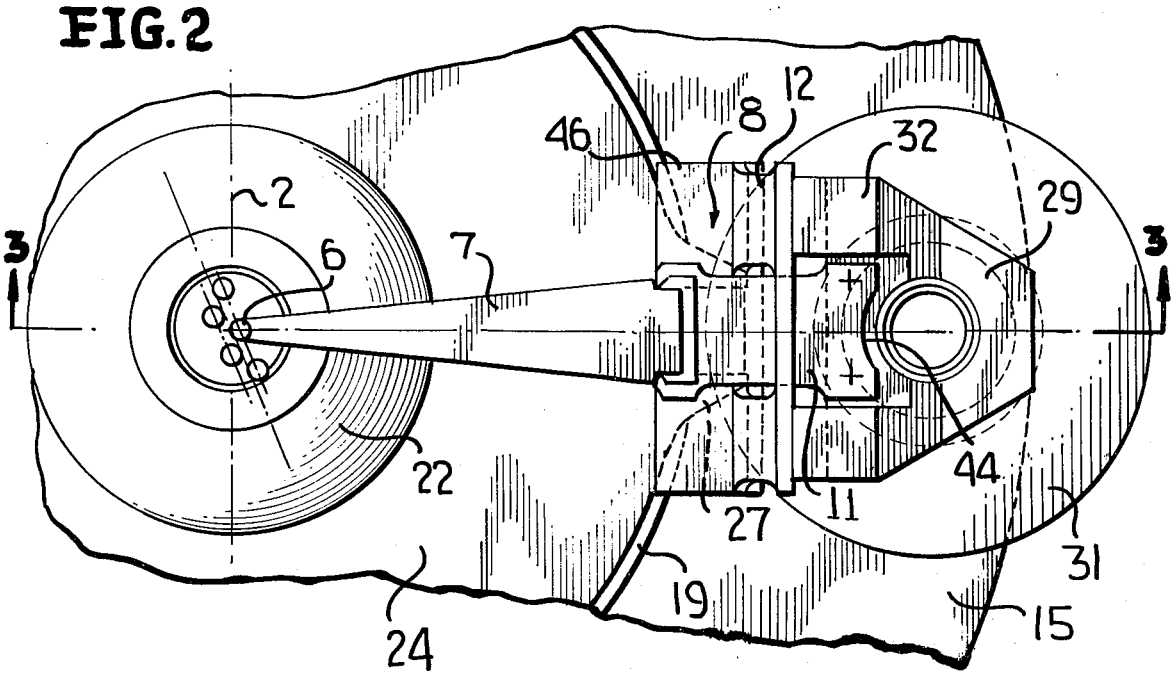
FIG. 2 is a detailed view of a single module of the invention viewed from the stylus side of the device.

Referring again specifically to FIGS. 1 to 3, the stylus drivers 1 are arranged generally circularly about a center point of the apparatus generally designated by the reference numeral 2. True concentricity is not provided since in order to provide necessary space at the stylus end of arms 7 while minimizing long stylus bendings, the styli are arranged in two parallel rows 3 and 4 of 4 needles each and are deflected at their upper ends to form a single row of 8 styli.

The styli which are generally designated by the reference numeral 6 are carried on one end of generally radially arrayed arms 7 pivoted at flexure 8.

Figure 3:
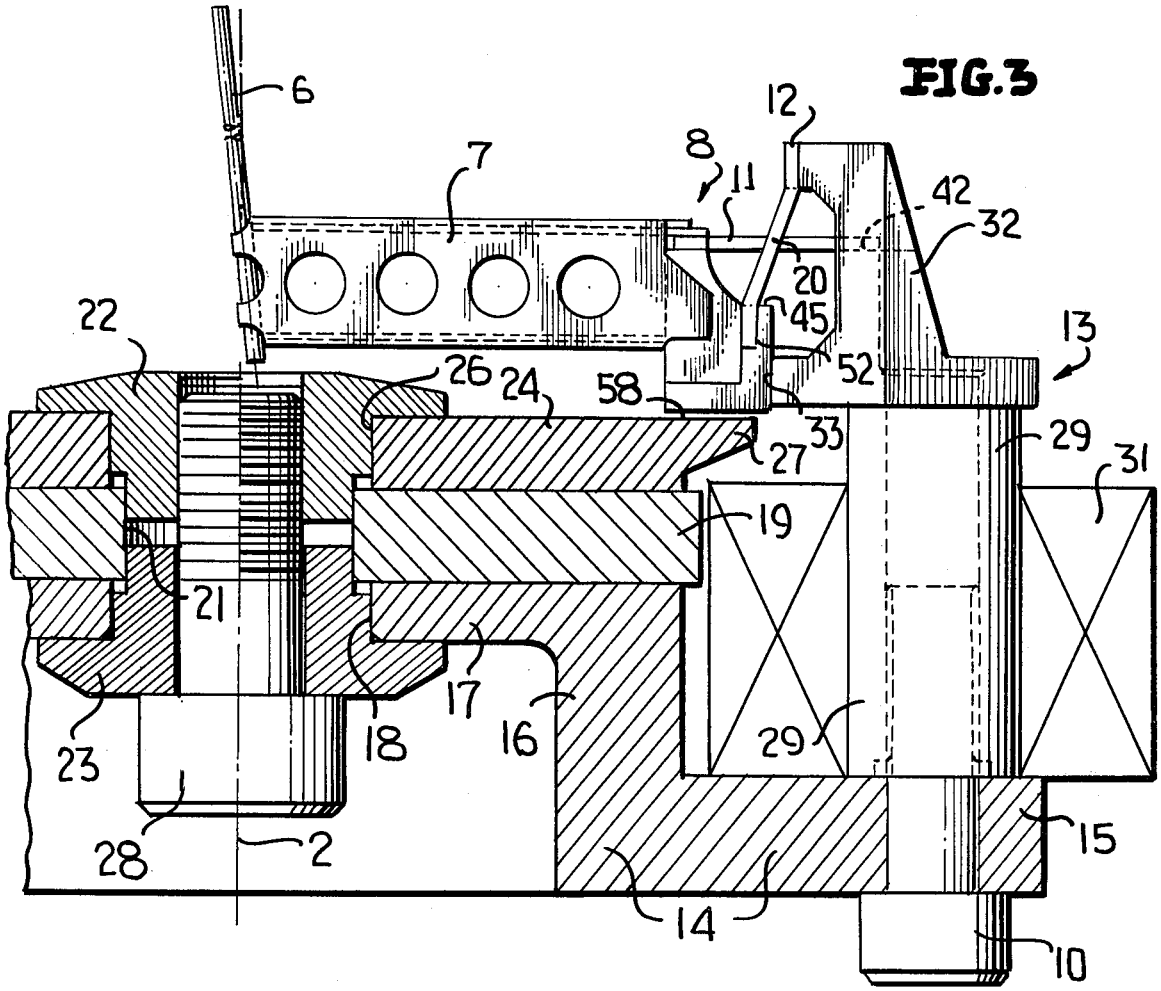
FIG. 3 is a view in section taken along section line 3—3 of FIG. 2.

The arm 7 overlies a magnetic circuit structure generally designated by reference numeral 9 in FIG. 3 and is supported on crossed-flexures 11 and 12 supported at their right and upper ends respectively, as viewed in FIG. 3 on a pole structure 13 of the magnetic circuit.

The magnetic circuit comprises a base 14 illustrated in FIG. 3 having a centrally located upstanding hollow cylindrical hub 16 terminating at its upper end in an inwardly extending disc 17 containing central aperture 18. The lower end of hub 16 terminates in outwardly extending flange 15, containing holes to receive machine screws 10, for attaching poles 13 and coils 31 to the structure.

A generally circular permanent magnet 19 having a central aperture 21 is positioned on top of the disc 17 of the hub 16 and is coaxial therewith.

Two retainers, upper retainer 22 and lower retainer 23 clamp and locate the magnet 19 between disc 17 and a disc 24. The disc 24 is coaxial with the hub 16, is centrally apertured at 26 and has a plurality of pole pieces 27 extending outwardly from its outer periphery along the centerlines of the arm 7.

The pole piece 13 of the electromagnetic structure is located at the upper end of and is preferably integral with a hollow cylinder 29 and is mounted by bolt 10 on the flange 15. The axis of the cylinder is parallel to the centerline of the hub 16 with the pole 13 of the electromagnet positioned on the upper end thereof with its bottom horizontal surface 30 just above the plane of the upper surface of the disc 24. A coil 31 of insulated conductive wire is disposed about the cylinder 29 which forms the core of the electromagnet.

The main body of the pole piece 13 rises from the surface 30 to provide an upstanding member 32 which extends horizontally outwardly from the cylinder 29 in all directions but primarily inwardly along the centerline of arm 7 and transversely thereof.

The inward projection of the member 32 along its surface 30 terminates in an elongated vertical surface 33 which forms the pole of the electromagnet as shown in FIG. 4. The surface 33 terminates at its upper end in a large transverse horizontal groove 34 that in turn terminates in an inward projection which is bifurcated by a vertical recess 36 lying along the centerline of the arm 7 thereby to provide two flexure support members 37 and 38. The members 37 and 38 have vertical surfaces 39 and 41 which lie between the recess 34 and the top of the pole piece 32. These surfaces form support surfaces for one leaf spring 12 of the crossed flexure support for the arm 7.

The recess 36 in pole piece 32 terminates in a flat horizontal surface 42 which provides support for a second leaf spring 11 of the crossed flexure support for the arm 7.

Various other recesses, grooves and cuts are made in the member 32 but these are primarily for purposes of reducing weight or facilitating fabrication.

The arm 7 carries at its end remote from the stylus 6, an armature 46 of the magnetic circuit which armature also serves as the connection between the leaf springs 11 and 12 and the arm 7. As shown in FIG. 4, the armature has a width substantially equal to the width of the face 33 of member 32 and a height roughly twice said face to provide surface 45 facing the surface 33. The armature has a centrally located upward projection 47 providing a flat horizontal upper surface 48 for attaching the other end of leaf spring 11.

The rear portion of the armature 46 opposite surface 45, right side in FIG. 4 and left side in FIG. 3, is recessed on both sides of the projection 47 to provide two recesses 51 and 52. The leaf spring 12 is bifurcated to form an upside down U-shaped member having legs 53 and 54 and a base 56. The ends of legs 53 and 54 are received in and brazed to adjacent surfaces at the recess 51 and 52 respectively. The base 56 of the U-shaped member is secured to the surfaces 39 and 41 of member 32 again preferably by brazing.

The arm 7 which forms the subject matter of U.S. patent application Ser. No. 865,006 filed Dec. 27, 1977, and divisional application Ser. No. 29,658 filed April 13, 1979, by the present inventor and both assigned to the same assignee as the present invention, is provided with two side tabs 57 which are positioned against surfaces 49 extending down from surface 48 of the armature and are brazed thereto.

Referring specifically to FIG. 3, the various elements of the apparatus are dimensioned such that the armature 46 lies parallel to and just above the projection 27 of the disc 24, defining a small air gap 58 therebetween. In the absence of energization of the electromagnet coils 31, the flux produced by the magnet 19 holds the armature 46 against pole surface 33 of the electromagnet. In this position, the flexures 11 and 12 are highly stressed and apply a clockwise moment about the center of crossed flexures 11 and 12, to the arm 7 in an attempt to move the stylus 6 upward.

Figure 7:
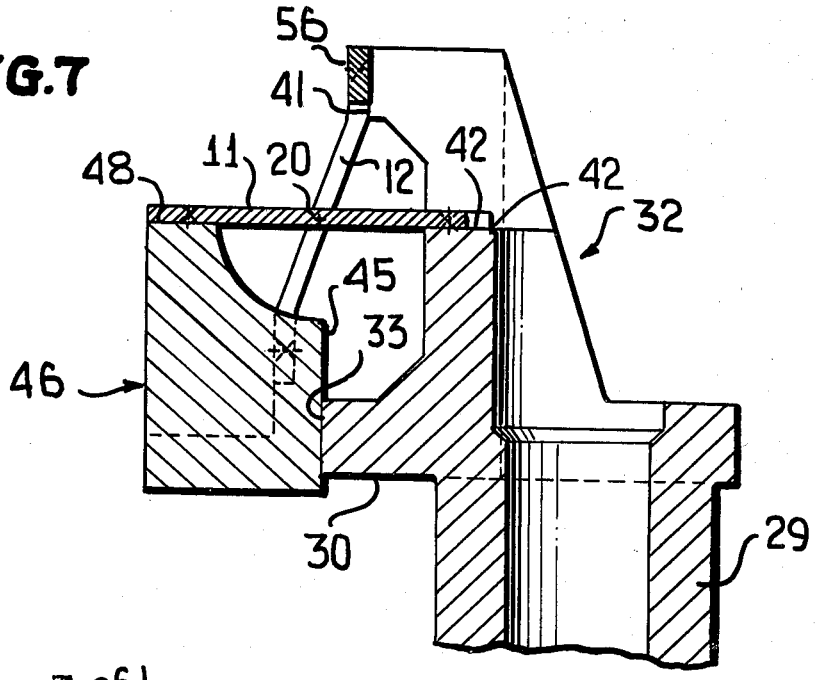
FIG. 7 is a section taken along section line 7—7 of FIG. 5.

In the position of the armature illustrated in FIG. 3, the centerlines of the flexures 11 and 12 cross at a point in space 20 lying in the plane of contact between surface 45 of the armature 46 and surface 33 of pole piece 32. This feature is achieved by appropriate dimensioning of the armature 46 and member 32 such that the flexure 12 must be angled down and to the left as viewed in FIGS. 3 and 7 whereby it intersects the flexure 11 at the aforesaid location. This feature is extremely important to the ability to provide long life without oiling since it permits the force of impact of the armature 46 against surface 33 to be precisely at right angles to such surfaces thus materially reducing fretting of the surfaces against one another.

An additional feature which is important to reduction of wear, is the use of the pole 13 as the support for the flexures 11 and 12. The arm may be located quite close to the pole 13 thus a rigid structure permitting little, if any, movement (fidgetting) between the armature 46 and pole 13. Thus, virtually no scuffing of the members occurs and very long life is provided; the armature and pole being the only members subject to mechanical damage except for the guide block and styli which are of no importance to the present invention.

The location of the supports for the arm 7 also greatly simplifies and facilitates the assembly of the apparatus. The armature is secured to the arm 7 and the flexures 11 and 12 and then clamped against the surface 33 of pole piece 32 in precise alignment. The flexures are then secured to their support surfaces and assembly is complete.

The statement that the armature 46 is located at a corner of a generally rectangular magnetic circuit structure refers to the fact that flange 15 forms the bottom of the rectangle while the cylinder 29 forms the right leg thereof. The lower horizontal part of pole piece 32 forms a partial upper side of the rectangle and the hub 16, magnet 19 and disc 24 form a partial left leg. The projection 27 of disc 24 and the armature complete the left and top legs of the rectangle. It should be noted that all of the elements recited except the magnet 19 are made of highly permeable materials such as soft iron or silicon or some of the newer materials capable of sustaining even higher flux densities. In many instances, soft iron or silicon is preferrable since they can be easily machined and are less expensive.

Torques produced by magnetic forces in the two air gaps resulting when the armature 46 is unseated are additive due to the manner of positioning said armature. Specifically, during a printing cycle, the electromagnet is energized and produces flux in opposition to that of the permanent magnet 19 so that the magnetic force exerted on armature 46 is reduced well below the force exerted by flexures 11 and 12. The arm is rotated about the flexure center 20 causing the stylus 6 to impact on an inked ribbon causing it to contact the surface on which printing is to occur. Rotation of the arm about its pivot causes an air gap to form between surfaces 33 and 45. The gap between armature 46 and projection 27 of disc 24 also increases since the armature is rotated upwardly as well as to the left about its pivot.

The force of impact of the stylus on the ribbon, paper, and platten causes the arm to rebound and before this time the electromagnet was de-energized. Thus, flux is re-established in the aforesaid gaps and pulls the armature to the position illustrated in FIG. 3. The downward force exerted on the armature lies entirely to the left of the pivot and thus exerts a torque producing counterclockwise rotation of the arm 7. The force on the armature exerted by the flux emanating from pole surface 33 is horizontal and well below the pivot point and also exerts a counterclockwise torque on the arm. Thus, the forces acting on the arm are additive and are larger than available from the patented device when utilizing comparable size elements.

The magnetic circuit structure of the present invention is quite compact so that magnetic circuit length is held to a minimum as determined basically only by size of the essential components of the magnetic circuit. The length of the structure among other things determines the reluctance of the magnetic path and thus the flux that may be established therein by the magnet. The reduction in path length has been found to reduce leakage flux and to permit a 20% reduction in magnet thickness relative to the patented device further reducing path length.

An additional feature which contributes to the overall performance available from the apparatus is the location of the coils 31 at the outer edge of the head. Cooling is quite good, permitting the current through the coil to be comparatively large without producing overheating. In consequence the coils may be made smaller (shortened) further decreasing circuit length.

From the above, the additive forces produced in the operating air gaps, the high flux in the magnetic circuit resulting from its minimal length and the high currents permissible in the coils has produced a head in which sustained speeds of operation of 800 characters (3.8 KC) per second can be readily achieved. The break away and restoring forces on the armature may be and are made approximately equal so that rapid return of the arm is achieved; this also being a contributing factor to the speed of operation.

The speed of operation set forth above produces printing at approximately six 132 character lines per second; this number being somewhat reduced (five such lines) when through-put speeds are considered due to non-printing time during carriage returns although the lost time may be reduced by printing in both directions.

The printing head of FIGS. 1–7 utilizes what is referred to as a long needle so that a guide block (not illustrated) for the needles may be located between the arms 7 and the surface to be impacted by the styli. The guide block may cause the styli to be curved so that all of the needles are aligned in a single row. Alternatively, the needles may be maintained in the position of FIG. 1 to provide a large space between needle receiving apertures in the guide block. It is believed apparent that if all of the needles 6 are aligned in a single row the material between holes is quite small and the expense of drilling is high. The staggering of needles increases the volume of material between holes, and reduces cost of drilling. In such an arrangement and in the head of FIG. 8, the styli are offset by a suitable number of timing cycles of the print control clock in the electronic control circuits. Specifically, if the head moves from left to right as viewed in FIG. 1, appropriate needles of the right row are energized and after a time delay equal to the time required to transport the head a distance equal to the separation between the central lines of the right and left row of needles, appropriate needles of the left row are energized. Thus, the imprints on the print medium are aligned.

The guide block is employed when variable pitch printing is desired or more exact alignment of needles is required to produce excellent copy. If the desired quality of the printing is not required to be of such high quality, acceptable quality is produced by the arrangement of FIG. 8 which eliminates the guide block but utilizes short needles so that whipping of the needles may be reduced to levels such as to produce acceptable print quality.

Figure 8:
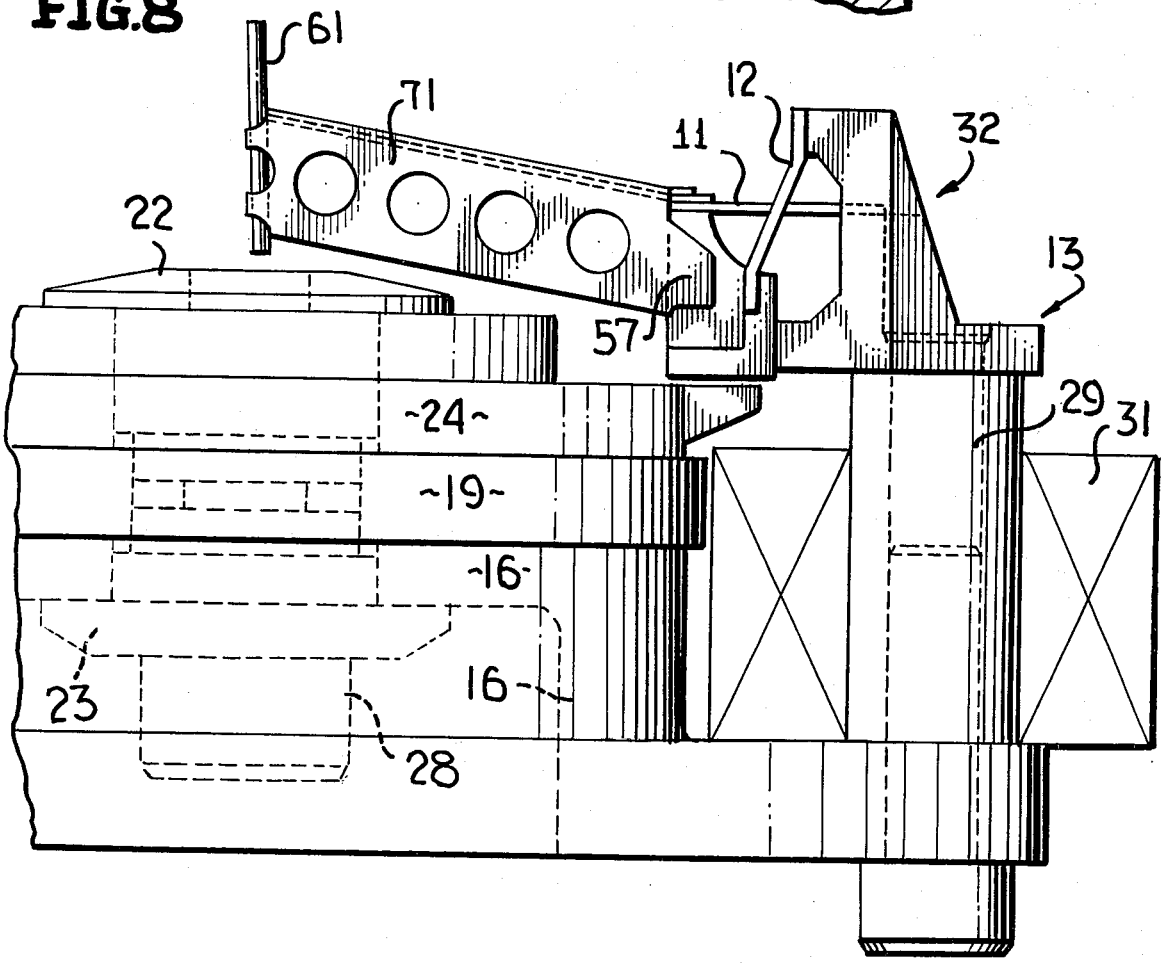
FIG. 8 is a view in elevation of a modified form of the apparatus of FIGS. 1-7.

Referring specifically to FIG. 8 of the accompanying drawings, there is illustrated a short needle version of the invention. Like parts carry the same reference numerals as in FIGS. 1–7 (with primes) since such parts are identical in both versions.

In the short needle version of the apparatus all parts are identical except for the needle and printer arm itself. The extra space on top of magnet 24′ may be eliminated. Printer arm 7′ of FIG. 8 is angled upward to the left of tabs 57 to permit a short strong stylus to reach the inked ribbon and paper which must clear the top of structure 32. This clearance is kept small to minimize the side motion of the stylus as it impacts ribbon and paper whereby smudging is reduced and the alignment of marks made on the paper is not overly sensitive to the stylus travel required to produce the marks. The operation of the device of FIG. 8 is otherwise identical to the other embodiment.

The important feature of the head of FIG. 8 is that because of the location of the printer arm above all other elements of the structure an upwardly angled arm may be used without requiring any modification of the other elements of the apparatus of the prior figures. All of the other advantages of the long needle embodiment are achieved by the short needle embodiment.

Summarizing some of the features which contribute to the high speed and long life of this head, the electromagnetic pole and support of the flexures of the arm are formed from a unitary body so that in the presence of vibration the pole and support move together to minimize rubbing of the armature on the pole. Further, the arm and armature arrangement is such that the armature is directly supported by the flexures which in conjunction with the miniscule mass of the arm permits great constraint on unwanted movement of the armature relative to the pole, i.e. vibrations of the armature and system are highly damped. Further, the ability to locate the pivot point in the plane of pole-armature interface further reduces relative movement between the contact surfaces. Additional damping of vibrations of the arm results from the fact that the two working air gaps (when the arm is being returned from a printing operation) work together to pull the armature back; providing a very definite moment arm.

The result is a head operating comfortably at 800 characters per second and an indefinite life; apart, of course, from wear of the stylii and guide block if such is employed.

Once given the above disclosure, many other features, modifications and improvements will become apparent to the skilled artisan. Such other modifications, features and improvements are, therefore, considered a part of this invention, the scope of which is to be determined by the following claims:

What I claim is:

1. A module for a multi-module dot matrix printer head comprising:

a selectively actuatable electromagnet, a pole piece for said electromagnet, a permanent magnet, a pole piece for said permanent magnet, a magnetic circuit including said electromagnet and permanent magnet and said pole pieces, said pieces having faces lying generally perpendicular to and in close proximity to one another, an armature having two adjacent perpendicular surfaces lying parallel, respectively, to said faces of said pole pieces with one of said surfaces contacting one of said faces when said electromagnet is not actuated, a pair of crossed flexures providing a pivotal axis for said armature, said pivotal axis lying in the plane of the face of said one of said pole pieces and remote from both of said pole pieces such that when the electromagnet is not actuated each surface of the armature is attracted toward the respective pole piece face to which each such surface is parallel when the electromagnet is not actuated, and wherein actuation of the electromagnet (a) produces a bucking magnetic field which at least partially cancels the magnetic field of the permanent magnet and (b) results in (i) the release of prestressed flexures in response to reduction in magnetic forces and torques on the flexures and (ii) the armature rotating about the pivotal axis thereof responsive to the release of the flexures, each surface of the armature thereby moving away from the respective pole piece face to which each such surface is parallel when the electromagnet is not actuated.

2. A printing head comprising a plurality of said modules of claim 1, said permanent magnet means is a single permanent magnet common to all of said modules.

3. A printing head according to claim 1 or 2 wherein said permanent magnet is a circular disc, said permanent magnet pole piece being circular and coaxial with and mounted on said permanent magnet, said modules spaced about said permanent magnet pole piece to provide generally circular array of modules.

4. A printing head according to claim 3 further comprising a member having a centrally located hub and a flange extending therefrom, said permanent magnet pole pieces being mounted on said hub coaxially thereof, said electromagnets being secured to said flange.

5. A module for a multi-module dot matrix printer head according to claim 2 wherein said electromagnet includes a coil, said pole piece for said electromagnet being secured at an end of said coil remote from said flange, said pair of flexures being secured to said pole piece of said electromagnet remote from said flange.

6. A printing head according to claim 2 further comprising a printer arm for each module, each said printer arm being secured to a different one of said armatures.

7. A printing head according to claim 6 further comprising a stylus secured in each said printer arms, said styli being arrayed in two parallel rows with essentially equal spacing between each styli in a row, said printer arms each having its centerline passing through the center of its associated stylus.

8. A module according to claim 1 wherein said electromagnet has a core, said core and said pole piece for said electromagnet being a single piece of material of high flux permeability.

9. A printer head comprising a relatively flat and annular permanent magnet, a support for said magnet having a flange, a plurality of electromagnets each having an electric coil disposed approximately equidistant from adjacent coils about said flange generally coaxial with said permanent magnet, a pole piece for each of said electromagnets disposed adjacent an end of said coil remote from said flange, each said pole piece extending generally toward the axis of said annular permanent magnet, a permanent magnet pole disposed adjacent an end of said permanent magnet remote from said flange and having its outer periphery adjacent to but disposed inwardly of said pole pieces associated with said coils, an armature associated with each of said electromagnets, and means for supporting each said armature adjacent to said permanent magnet pole and for movement into contact with said pole of its associated electromagnet.

10. A printer head according to claim 9 wherein each said pole pieces of said electromagnets is elongated along a dimension extending a predetermined distance away from and generally transverse to said coil, a first support surface formed on said pole lying in a plane generally parallel to said elongated dimension, a second support surface disposed adjacent said first support surface and generally perpendicular thereto.

11. A printer head according to claim 10 wherein said means for supporting further comprises for each armature a pair of prestressed crossed flexures, said flexures crossing one another generally in the plane of contact between said armature and said pole of its associated electromagnet, and means securing one end of each of said flexures to a different one of said first and second surfaces of said pole of said electromagnet and the other end of said flexures to said armature.

12. A printer head according to claim 11 further comprising an arm secured to each said armature;

each said arm extending from its associated armature generally toward the axis of said annular permanent magnet.

13. A printing mechanism comprising:

an arm;

a print member secured to one end of said arm;

an armature for a magnetic circuit secured adjacent another end of said arm;

flexible support means for said arm;

a generally rectangular magnetic circuit having four legs;

said magnetic circuit including a permanent magnet in one leg and an electromagnet in another leg;

two adjacent legs of said rectangular structure which lie perpendicular to one another each being short relative to the leg parallel thereto to provide a single open corner of said rectangular magnetic circuit;

said armature being located in said open corner to substantially complete said rectangular structure;

the flux from said permanent magnet (a) holding said armature in contact with one of said short legs which is generally parallel to said arm and (b) attracting said armature to the other of said short legs;

said permanent magnet being located in the other of said short legs; and wherein actuation of the electromagnet (a) produces a bucking magnetic field which at least partially cancels the magnetic field of the permanent magnet and (b) results in (i) the release of prestressed flexures in response to reduction in magnetic forces and torques on the flexures and (ii) the armature rotating about the pivotal axis thereof responsive to the release of the flexures, each surface of the armature thereby moving away from the respective pole piece face to which each such surface is parallel when the electromagnet is not actuated.

14. A printing mechanism according to claim 13 wherein said electromagnet and permanent magnet are disposed in generally parallel legs of said rectangular structure.

15. A printing mechanism according to claim 13 wherein said one of said short legs is a pole of said electromagnet.

16. A printing mechanism according to claim 15 wherein said leg including said permanent magnet terminates in a flat surface parallel to said arm and lying adjacent at least a part of said armature whereby the force vector between said armature and said flat surface is generally perpendicular to the force between said armature and said pole of said electromagnet.

17. A printing mechanism according to claim 16 wherein the surface of contact between said armature and said one of said short legs is perpendicular to the direction of movement of said arm, and said flexible support means confines said armature to traverse a path moving said armature away from said flat surface and said pole of said electromagnet concurrently.

18. A printing mechanism according to claim 13 wherein said magnetic circuit is saturated by said permanent magnet.

19. A magnetic structure comprising:

an armature;

means for supporting said armature for movement along a prescribed path;

a magnetic circuit including (a) a permanent magnet and (b) an electromagnet for selectively producing mmf through said circuit in opposition of the mmf of the permanent magnet;

said magnetic circuit having a gap therein lying between two angularly related sections of said magnetic circuit;

said armature being disposed in said gap;

one of said sections being disposed in said path of movement of said armature whereby the flux between said armature and said sections produces attractive forces which produce torques that add vectorially responsive to flux emanating only from the permanent magnet; and wherein actuation of the electromagnet (a) produces a bucking magnetic field which at least partially cancels the magnetic field of the permanent magnet and (b) results in (i) the release of prestressed flexures in response to reduction in magnetic forces and torques on the flexures and (ii) the armature rotating about the pivotal axis thereof responsive to the release of the flexures, each surface of the armature thereby moving away from the respective pole piece face to which each such surface is parallel when the electromagnet is not actuated.

20. A module for a multi-module dot matrix printer head comprising:

a selectively actuatable electromagnet;

a pole piece for said electromagnet;

a permanent magnet;

a pole piece for said permanent magnet;

a magnetic circuit including said magnets and said pole pieces;

each pole piece having a face, the face on one pole piece lying generally perpendicular to and in close proximity to the face on the other pole piece, the two faces together forming a right angle with a small gap at the apex therebetween;

an armature having (a) a first surface and (b) a second surface which is perpendicular to the first surface, the first surface lying parallel to one face of said one pole piece and the second surface lying parallel to and abutting said face of said other pole piece when said armature is in its quiescent position when the electromagnet is not actuated; and a pair of crossed flexures which mechanically position said armature in said magnetic circuit;

said pair of flexures providing a pivotal axis about which the armature is rotatable relative to the magnetic circuit;

said pivotal axis being (a) in the plane of the face against which the second surface abuts when the electromagnet is not actuated and (b) remote from both of said pole pieces; and wherein actuation of the electromagnet (a) produces a bucking magnetic field which at least partially cancels the magnetic field of the permanent magnet and (b) results in (i) the release of prestressed flexures in response to reduction in magnetic forces and torques on the flexures and (ii) the armature rotating about the pivotal axis thereof responsive to the release of the flexures, each surface of the armature thereby moving away from the respective pole piece face to which each such surface is parallel when the electromagnet is not actuated.

21. A module according to claim 20 wherein (a) said electromagnet has a cylindrical shape and a longitudinal axis therethrough and (b) said permanent magnet comprises a circular disc having a longitudinal axis therethrough;

wherein the longitudinal axis of the electromagnet and the longitudinal axis of the permanent magnet are in a common plane; and wherein the pivotal axis of the armature is nearly perpendicular to said common plane.

22. A module according to claim 21 further comprising:

a straight arm extending from the armature, the arm having a centerline along its length which at least nearly lies in the common plane.

23. A module according to claim 22 wherein the centerline of the arm is disposed (a) at least nearly perpendicular to the plane of the second surface of the armature and (b) at least nearly parallel to the plane of the first surface of the armature.

24. A module according to claim 20 wherein each of said two perpendicularly disposed faces of said two pole pieces applies an attractive magnetic force to the armature when the electromagnet is not actuated, thereby effecting additive moments about the pivotal axis.

25. A module according to claim 1 wherein each of said two perpendicularly disposed faces of said two pole pieces applies an attractive magnetic force to the armature when the electromagnet is not actuated, thereby effecting additive moments about the pivotal axis.

26. A module according to claim 1 wherein said crossed flexures have a fast spring-rate, such that the force on a prestressed flexure when released quickly decreases.

27. A module according to claim 1 or 20 wherein said crossed flexures apply an accelerating force to said armature in a direction away from said pole piece faces, such that said armature accelerates away from said pole piece faces when the electromagnet bucks the permanent magnet.

* * * * *